United States Patent [19]

Sunakawa

[11] Patent Number: 4,775,039

[45] Date of Patent: Oct. 4, 1988

[54] ELECTRICALLY-OPERATED, CURTAIN DRAWING/UNDRAWING MECHANISM

[75] Inventor: Kazumi Sunakawa, Tokyo, Japan

[73] Assignee: Yokota Co., Ltd., Japan

[21] Appl. No.: 7,572

[22] Filed: Jan. 28, 1987

[30] Foreign Application Priority Data

Jan. 27, 1986 [JP] Japan ..... 61-8915

[51] Int. Cl.[4] ..... F16D 43/00; A47H 1/00

[52] U.S. Cl. ..... 192/0.02 R; 160/331; 192/142 R

[58] Field of Search ..... 160/331, 310, 311; 192/0.02 R, 142 R

[56] References Cited

U.S. PATENT DOCUMENTS

| | | | |
|---|---|---|---|
| 2,311,321 | 2/1943 | Zigan | 192/0.02 R |
| 2,314,019 | 3/1943 | Shaw | 192/0.02 R |
| 2,366,739 | 1/1945 | McCoy | 192/0.02 R |
| 2,468,453 | 4/1949 | Mallentjer | 160/331 |
| 2,568,808 | 9/1951 | Johansen | 192/0.02 R |
| 2,936,052 | 5/1960 | Snarr | 192/0.02 R |
| 3,042,001 | 7/1962 | Dubie et al. | 160/331 X |
| 3,429,298 | 2/1969 | Thomason | 160/331 X |

FOREIGN PATENT DOCUMENTS

| | | | |
|---|---|---|---|
| 2562736 | 10/1985 | France | 160/310 |

*Primary Examiner*—Rodney H. Bonck

*Attorney, Agent, or Firm*—Lowe, Price, LeBlanc, Becker & Shur

[57] ABSTRACT

An electrically-operated curtain drawing/undrawing mechanism comprises a reduction gear connected on the output shaft side of a motor and a driving pulley connected to the reduction gear through an electromagnetic clutch, and further includes an operating switch for sending an operating signal to an electromagnetic clutch circuit in which the electromagnetic clutch is incorporated, and a control logic circuit for sending an operating signal for the motor to the electromagnetic clutch circuit, the electromagnetic clutch circuit being provided for sending the operating signal for sending the operating signal for the electromagnetic clutch to the control logic circuit. Ball bearings are incorporated in the respective bearing portions of a driven pulley and leading curtain runner's wheels.

3 Claims, 3 Drawing Sheets

ELECTRICALLY-OPERATED, CURTAIN DRAWING/UNDRAWING MECHANISM

FIELD OF THE INVENTION

The present invention relates to a mechanism for electrically drawing and undrawing a curtain and the like, which is especially designed to be operated both electrically and manually.

STATEMENT OF THE PRIOR ART

A conventional means for drawing or undrawing a curtain uses a motorized electrically-operated drawing-/undrawing mechanism. A curtain rail is provided with driven or follower pulleys at its both ends, and a driving unit has a built-in integrated circuit (IC) and is of the structure that a driving pulley is connected on the side of an output shaft of a motor through a reduction gear for the transmission of power. The driving pulley is then connected with the driven pulleys by means of an endless belt, which is coupled at its given position to a leading curtain runner to which a leading edge of the curtain is fixed. By movement of the endless belt, the leading edge of the curtain is moved within the curtain rail to draw or undraw the curtain.

Upon completion of drawing or undrawing of the curtain, the revolution of the motor shaft is automatically detected to stop the motor.

One problem with the aforesaid electrically-operated conventional drawing/undrawing mechanism is, however, that even when the motor is automatically stopped at the time of completion of drawing or undrawing of the curtain, the reduction gear connected on the output shaft side of a motor and the driving pulley are in engagement. Thus, it is virtually impossible to manually draw or undraw the curtain due to the braking resistance of the motor, the resistance that causes reversal actuation of the reduction gear and the frictional resistance of wire or pulley portions. In particular, it is impossible to draw or undraw the curtain if a power outage occurs. Another problem is that curtains may be torn off, when electrically-operated drawing/undrawing mechanisms installed in hotels, etc. are inadvertently or accidentally handled as if they were ordinary manual drawing/undrawing mechanisms in a rapid drawing or undrawing thereof.

SUMMARY OF THE INVENTION

A main object of the present invention is to provide an electrically-operated curtain drawing/undrawing mechanism (hereinafter referred to as the drawer mechanism) which is designed to automatically detect a signal at the time of completion of drawing or undrawing of a curtain to (1) stop a motor and (2) send a signal to an electromagnetic clutch circuit to release an electromagnetic clutch, whereby power transmission between a driving pulley and a reduction gear is cut off to separate the reduction gear and motor from the driving pulley.

According to the present invention, this object is achieved by providing an electrically-operated curtain drawing/undrawing mechanism comprising a reduction gear connected on the output shaft side of a motor and a driving pulley connected to the reduction gear through an electromagnetic clutch. The mechanism includes an operating switch for sending an operating signal to an electromagnetic clutch circuit in which the electromagnetic clutch is incorporated, and a control logic circuit for sending an operating signal for said motor to said electromagnetic clutch the electromagnetic clutch circuit is provided for sending the operating signal for the electromagnetic clutch to the control logic circuit. Ball bearings are provided in the respective bearing portions of the driven pulleys and wheels of a leading curtain runner.

More specifically, the drawer mechanism according to the present invention includes a main circuit defining a closed circuit comprising a motor, a power source and a.c. control elements, a control logic circuit adapted to control the a.c. control elements of the main circuit and connected to the main circuit through a photo-coupler, an operating switch for sending an operation command signal to the control logic circuit and an electromagnetic clutch circuit, an electromagnetic clutch circuit for sending a stop signal for an electromagnetic clutch to the control logic circuit and receiving a stop signal for the motor from the control logic circuit, a protective circuit connected in between said control logic circuit and said operating switch and a revolution detecting circuit for detecting the revolutions of the motor of said main circuit to digitalize the resulting signal and send it to said control logic circuit. Thus, the mechanism according to the present invention digitally detects the stop signal for the motor at the time of completion of drawing or undrawing of a curtain or the like, and automatically releases the electromagnetic clutch to cut off the transmission of a power between a driving pulley and a reduction gear, so that the curtain can easily be drawn or undrawn manually in the state where the motor is not at work.

It is also possible to easily and manually draw or undraw a curtain due to an extremely limited frictional resistance, since the bearing portions of the driven pulleys and wheels of a leading runner, which work corresponding to the drawing or undrawing movement of the curtain, are ball bearings.

BRIEF DESCRIPTION OF THE DRAWINGS

The invention will now be described by way of example with reference to the accompanying drawings, wherein.

Figure 1:
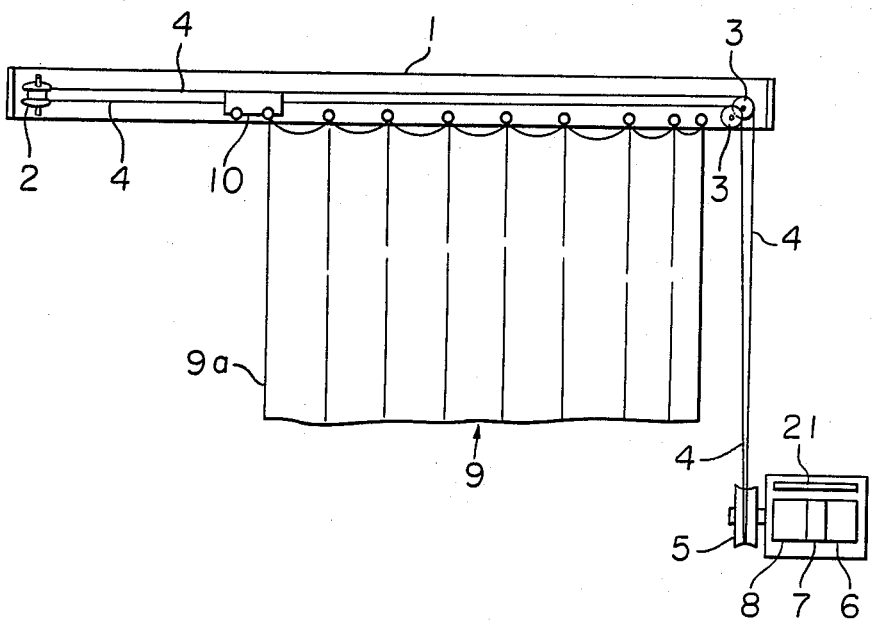
FIG. 1 is a schematical front view of one embodiment of the curtain drawer mechanism in the electrically-operated drawing/undrawing system according to the present invention.

Referring first to FIG. 1, a curtain rail 1 is provided with driven or follower pulleys 2 and 3 at both ends. A driving unit is incorporated with an integrated circuit (IC) 21, and includes driving means comprising a reduction gear 7 located on the side of an output shaft of a motor (an a.c. electrical motor) 6 and an electromagnetic clutch 8 through which the reduction gear 7 is connected with a driving pulley 5 for the transmission of a power from the motor 6. The driven pulleys 2,3 are connected with the driving pulley 5 by an endless wire or belt 4, connected with a leading curtain runner 10 to which a leading edge *9a* of a curtain 9 is fixedly attached. Thus, the leading edge *9a* of the curtain 9 moves within the curtain rail 1 by movement of the endless wire 4 to draw or undraw the curtain 9.

Figure 2:
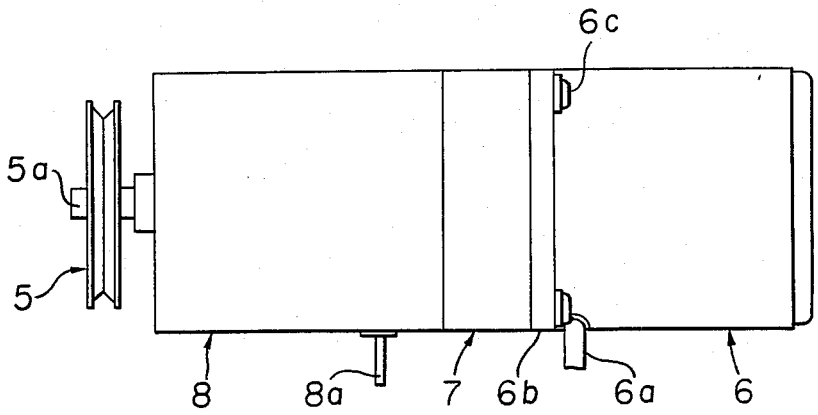
FIG. 2 is a schematical front view showing the driving unit.
Figure 3:
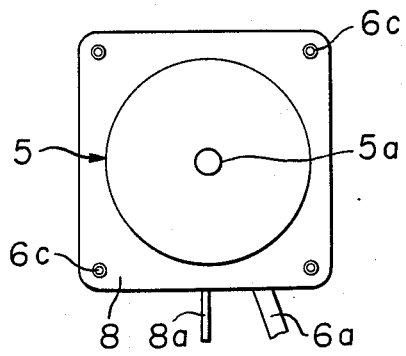
FIG. 3 is a schematical side view showing that unit.

As illustrated in FIGS. 2 and 3, the motor 6 is provided with a lead 6a and a flange 6b, and the reduction gear 7 is connected with the output shaft of the motor 6 on the left side of flange 6b. An electromagnetic clutch 8 having a lead 8a is connected with the left side of the reduction gear 7, and the driving pulley 5 is mounted onto the output shaft 6a of the motor 6. A through bolt 6c connects the motor 6, the reduction gear 7 and the electromagnetic clutch 8 through a frame.

Figure 4:
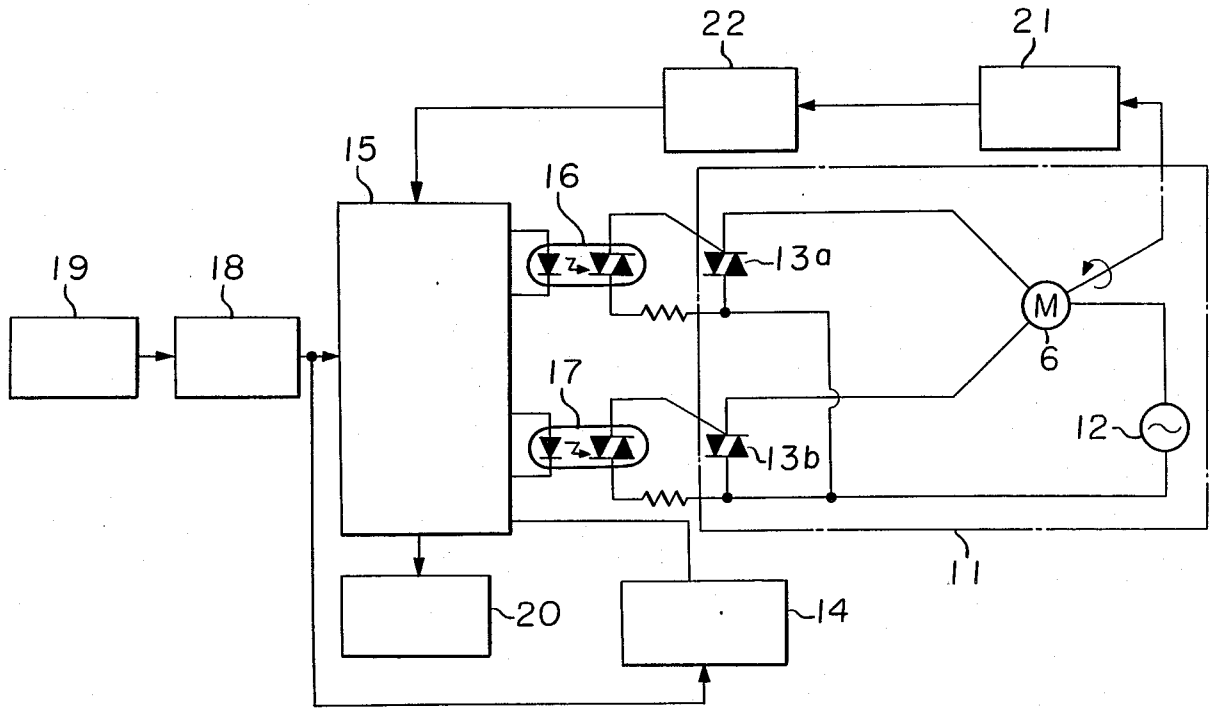
FIG. 4 is a block diagram illustrating said one embodiment of the present invention.

Referring to FIG. 4, a main circuit shown generally at 11 includes the motor 6, a power source 12 and triacs 13a and 13b acting as a.c. control elements which together define a closed circuit. The motor 6 then moves the the leading curtain runner 10 to draw or undraw the curtain.

A control logic circuit 16 controls the triacs (a.c. control elements) 13a and 13b of the main circuit 11, and is connected to the main circuit 11 through photo-triac couplers (photo-coupler elements) 16 and 17 defining an insulation type input circuit. An operating switch 19 sends an operating command signal to the control logic circuit 15 via a protective circuit 18. It is noted that the protective circuit 18 has its diode adapted to prevent a surge current from entering the control logic circuit 15 from the outside.

An actuation display circuit 20 is connected to the control logic circuit 15, and includes display means such as luminous diode means to indicate that the main circuit 11 and an electromagnetic clutch circuit 15 are electrically conductive, when the signal sent out of the control logic circuit 15 is an "H" state. Upon the operating switch 19 being pushed down, the electromagnetic clutch 8 incorporated in the electromagnetic clutch circuit 16 becomes conductive, so that return connection of the electromagnetic clutch 8 is effected to transmit the power of the reduction gear 7 located on the side of the output shaft of the motor 6 to the driving pulley 5. A revolution detecting circuit 21 is provided to detect the revolutions of the motor 6 when drawing or undrawing of the curtain 9 is completed, and to send the resulting signal to the control logic circuit 56 so as to cut off the supply of current to the main circuit 11 and hence the electromagnetic clutch circuit 14, thereby releasing the electromagnetic clutch 8 and separating the reduction gear 7 from the driving pulley 5, resulting in the transmission of power being cut off. In operative the electromagnetic clutch 8 sends an operating signal from the electromagnetic clutch circuit 14 to the control logic circuit 15. It is understood that a wave-form shaping circuit 22 shapes the wave-form of a signal obtained from the revolution detecting circuit 21, and sends it to the control logic circuit 15.

The control logic circuit 15 includes therein a time delay circuit for allowing the output signal of the control logic circuit 15 to be in an "L" state after the the lapse of given time from the interruption of the input signal. The protective circuit 18 is provided with a diode for preventing the occurrence of any surge current, corresponding to an operating button of the operating switch 19. It is here noted that the operating switch 19 comprises a push-button switch having a manually-operated automatic return contact.

The revolution detecting circuit 21 has a photo-coupler which is put into operation by allowing incident light rays to be digitally reflected from a reflector mounted on the motor 6. A digital signal from the photo-coupler is sent to the control logic circuit 15 through the wave-form shaping circuit 22, during which the control logic circuit 15 continues to send "H" signals. When the input of the digital signal is interrupted, however, the control logic circuit 15 sends out an output signal "L" after the lapse of a given time from the clock actuation of the time delay circuit. Simultaneously with the revolution of the motor 6 coming to a stop, the clutch 8 is released to cut off the transmission of a power between the reduction gear 7 and the driving pulley 5. The reason for provision of the time delay circuit is to distinguish the case where the curtain catches for unknown reasons during its drawing or undrawing movement from the case where the curtain is in a completely drawn or undrawn state. It is also noted that the protective circuit 18 is provided to remove or reduce noises.

Reference will now be made to the operation of the drawer mechanism as constructed above.

First, actuating the "close" button of the operating switch 19 causes the "H" signals to be fed to one logic terminal of the control logic circuit 15 and this causes the "H" signals to be sent out of the other logic terminal of the control logic circuit 15, thereby actuating the luminous diode of the actuation display circuit 20. Then, the diode of the photo-triac coupler 18 emits light, and the triacs including 13a become conductive. Thus, the motor 6 is driven for complete drawing of the curtain. When the curtain is completely drawn, the digital light rays reflected from the reflector attached to the motor are interrupted and detected by the photo-coupler of the revolution detecting circuit 21. In the manner explained above, the motor 6 is stopped, while the electromagnetic clutch 8 is released to cut off power transmission between the reduction gear 7 and the driving pulley 5.

On the other hand, when the "open" button of the operating switch 19, is actuated the curtain 9 is moved in the direction counter to that of the above movement for its complete drawing.

According to the present invention, when the motor 6 is stopped upon completion of drawing or undrawing of a curtain, the supply of current to the the electromagnetic clutch circuit 14 is cut off and the electromagnetic clutch 8 is released, so that the reduction gear 7 is disconnected from the driving pulley 5 to cut off the transmission of a power therebetween. Thus, when it is intended to draw or undraw the curtain in a manual manner, the curtain can easily be drawn or undrawn. According to the present invention, ball bearings are incorporated in the respective bearing portion of the driven pulleys 2, 3 and the wheels of the leading curtain runner for the purpose of reduction a frictional resistance occurring in drawing or undrawing the curtain.

It is understood that the present invention is not limited to the foregoing embodiment. By way of example, the motor may be provided with a tachogenerator to digitally sense a change in the waveform of voltage, thereby detecting its revolution. It is also understood that the present invention is applicable to drawing or undrawing of blinds, accordian doors, shutters etc.

What is claimed is:

1. In a curtain system that includes a curtain supported adjacent an upper edge by a plurality of moveable supports guided along a track between open and closed positions for the curtain, an electrical operating mechanism comprising:

an electric motor to provide operational torque through a reduction gear having a predetermined gear ratio;

an electrically engageable/disengageable clutch connected to said motor for receiving said operational torque therefrom and for selectively transmitting a corresponding rotational clutch output when in an engaged mode and not transmitting any clutch output when in a disengaged mode;

means for converting said rotational output from said clutch, in the engaged mode thereof, into a curtain-moving force for moving one of said moveable supports supporting said curtain along said guide track;

control means for selectively shifting said clutch into said engaged and disengaged modes; and control means for detecting the location of a moving portion of said curtain and, in response to detected movements of said portion, selectively providing power to engage said clutch and to operate said motor to move said curtain toward one of said open and closed portions thereof or cutting off power to disengage said clutch and stop operation of said motor wherein said curtain disengages from the motor and may be moved manually, further including time delay circuit means for preventing operation of the control means until a predetermined time has lapsed and which operation is indicative of clutch disengagement, said time delay circuit means being operable during movement of said curtain to sense disruption of movement of a moving portion of said curtain and distinguish between two different conditions of disruption, one of said conditions being caused by said curtain catching during its drawing or undrawing movement for a period of time less than said predetermined time and the other condition being said curtain reaching its open or closed state and thereby remaining in said state for a time greater than said predetermined time.

2. The mechanism as recited in claim 1, wherein said moveable supports include driven pulleys having bearing portions provided therein with ball bearings.

3. The mechanism as recited in claim 1, wherein said moveable supports include a leading curtain runner having a bearing portion provided therein with ball bearings.

* * * * *